US007547050B1

(12) United States Patent
Miglieri et al.

(10) Patent No.: US 7,547,050 B1
(45) Date of Patent: Jun. 16, 2009

(54) DRAWER SECURITY ATTACHMENT

(76) Inventors: Thomas J. Miglieri, 1464 Columbus, Bolingbrook, IL (US) 60490; Janet E. Miglieri, 1464 Columbus, Bolingbrook, IL (US) 60490

( * ) Notice: Subject to any disclaimer, the term of this patent is extended or adjusted under 35 U.S.C. 154(b) by 0 days.

(21) Appl. No.: 11/809,997

(22) Filed: Jun. 4, 2007

Related U.S. Application Data

(60) Provisional application No. 60/810,647, filed on Jun. 5, 2006.

(51) Int. Cl.
*E05C 19/06* (2006.01)
*A47B 88/00* (2006.01)

(52) U.S. Cl. ..... 292/84; 292/80; 292/87; 292/90; 292/288; 292/DIG. 60; 292/DIG. 65; 312/204; 312/330.1; 312/333

(58) Field of Classification Search ..... 292/80, 292/84, 87, 90, DIG. 65, DIG. 68, 288, DIG. 60; 312/204, 330.1, 333
See application file for complete search history.

(56) References Cited

U.S. PATENT DOCUMENTS

| | | | | |
|---|---|---|---|---|
| 3,381,992 | A | 5/1968 | Friesen | |
| 3,397,001 | A | 8/1968 | Friedman | |
| 3,879,072 | A | 4/1975 | Tuley | |
| 3,888,525 | A | 6/1975 | Kousens | |
| 3,889,992 | A | 6/1975 | Shelton | |
| 4,139,249 | A | 2/1979 | Hillman | |
| D261,355 | S | 10/1981 | Sundberg | |
| 4,378,948 | A | 4/1983 | Chrones | |
| 4,416,477 | A | 11/1983 | Bialobrzeski et al. | |
| D272,715 | S | 2/1984 | Bailey | |
| 4,505,526 | A | 3/1985 | Leck | |
| 4,702,536 | A * | 10/1987 | Kraynak | 312/330.1 |
| 4,715,628 | A * | 12/1987 | Brink et al. | 292/19 |
| 4,717,184 | A | 1/1988 | Boyce | |
| 5,445,451 | A | 8/1995 | Harmony | |
| 5,795,044 | A | 8/1998 | Trewhella, Jr. et al. | |
| 6,547,289 | B1 * | 4/2003 | Greenheck et al. | 292/126 |
| 6,997,527 | B2 * | 2/2006 | Cheng | 312/332.1 |
| 7,261,329 | B1 * | 8/2007 | Julian et al. | 292/84 |
| 2003/0048050 | A1 | 3/2003 | Wong et al. | |
| 2005/0218760 | A1 * | 10/2005 | Cheng | 312/333 |

FOREIGN PATENT DOCUMENTS

| | | |
|---|---|---|
| GB | 2272725 | 5/1993 |

OTHER PUBLICATIONS

"Swivel Drawer & Cabinet Locks", Baby Super Mall, http://www.babysupermall.com/main/products/kdc/kdc93330.html.

* cited by examiner

*Primary Examiner*—Carlos Lugo
(74) *Attorney, Agent, or Firm*—Erickson Law Group, PC

(57) ABSTRACT

A drawer security attachment includes an attachment flange or brackets and a cover extending from the bracket. The flange or brackets attach to the inner surface of the drawer face, and the cover extends across the width of the otherwise open top of the drawer to inhibit access to the drawer contents. The flange and cover may be a single, monolithic sheet of flexible plastic, or may comprise rigid components secured to one another by a hinge. The cover portion includes a catch engagement passage(s), with a pin(s) extending downwardly from the upper portion of the drawer opening. The panel is urged upwardly against the upper portion of the drawer opening, with the engagement passage(s) automatically catching on the pin(s) as the drawer is opened. The cover can include extendable wings to match an overall width of the cover to the drawer width.

16 Claims, 7 Drawing Sheets

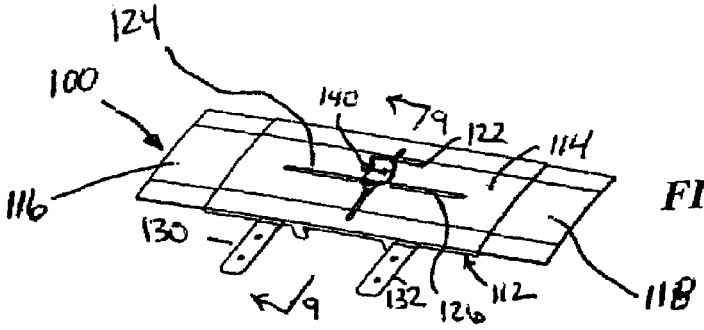
FIG. 5
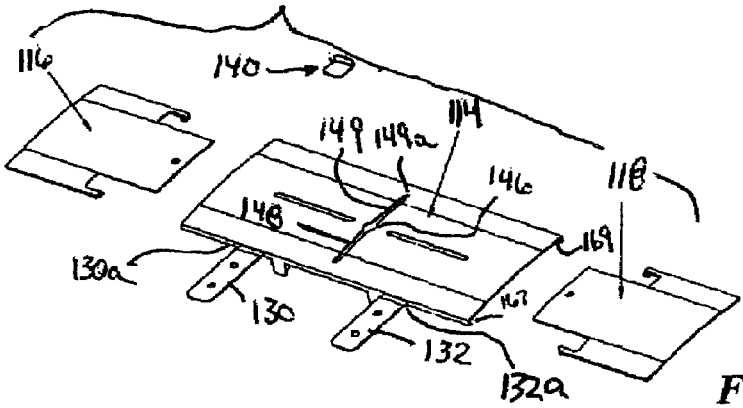
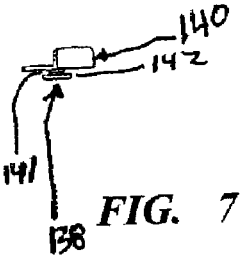
FIG. 7
FIG. 6
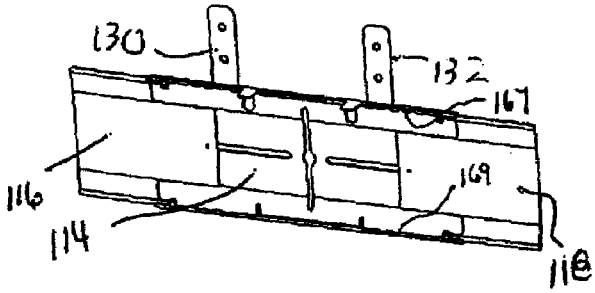
FIG. 8
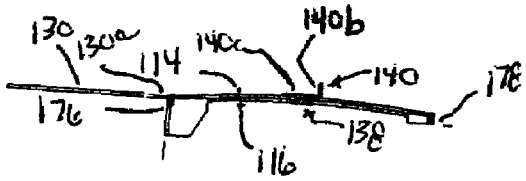
FIG. 9

DRAWER SECURITY ATTACHMENT

This application claims the benefit of U.S. Provisional Application Ser. No. 60/810,647, filed Jun. 5, 2006.

FIELD OF THE INVENTION

The present invention relates generally to security devices, and more particularly to a protective panel automatically deployed across the top of an open drawer to conceal and protect the contents of the drawer, particularly from younger and/or smaller children.

BACKGROUND OF THE INVENTION

The typical household contains innumerable devices and articles that are best kept from persons not authorized to see or use them. This is particularly true where children are living in the household, or at least have occasion to visit from time to time. People, and particularly children, tend to be curious and inquisitive by nature, and will explore areas that are, or should be, off limits to them. This has led to tragic accidents from time to time when unauthorized persons, particularly children, gain access to firearms, matches, knives, and/or other potentially hazardous or dangerous devices or materials without the knowledge of their parents or guardian. While such potentially dangerous articles as those noted above are of particular concern for the physical safety and well being of the child and/or others in the household, the list of articles and devices that should be kept from visitors and children goes far beyond those articles, and may include such sensitive devices as important documents, small valuables, etc.

Accordingly, a number of different devices have been developed to preclude or limit access to the drawer of a desk, kitchen drawers, chest of drawers, or the like. These various devices generally comprise relatively thin, elongate hooks, rods, or similar structures, which connect between the inner surface of the face of a movable drawer and the fixed structure (cabinet, chest, etc.) supporting the drawer. Some of these devices attach to the side of the drawer and engage the side of the drawer opening. All such devices are intended to drastically limit the opening of the drawer, but the relatively narrow shanks of such devices do nothing to prevent someone from reaching into the drawer through the limited opening provided. In fact, access to the drawer interior is required with most of these devices in order to allow a person to unhook or disconnect the device from the interior of the cabinet or chest in order to allow the drawer to be opened fully.

The present inventors have recognized that a person (particularly a small child with small hands) may reach into the drawer through the limited opening and access the contents of the drawer. The heretofore known devices do little to block the opening between the front of the drawer and the face of the cabinet or chest of drawers to preclude access to the contents of the drawer through the limited opening.

Thus, the present inventors have recognized that a drawer security attachment solving the aforementioned problems is desired.

SUMMARY OF THE INVENTION

The drawer security attachment has a continuous panel that extends from the inner surface of the face of a drawer across the otherwise open top of the drawer, and spans the entire width of the drawer to completely block access to the contents of the drawer. The device includes a drawer face attachment flange that secures to the inner surface of the face of the drawer, and a cover that extends over the otherwise open top of the drawer. The attachment flange and cover may comprise a single, monolithic sheet of flexible plastic, allowing the cover to flex at its juncture with the attachment flange, or may comprise relatively rigid components secured to one another by a mechanical hinge or series of hinges. In the various embodiments, the cover is urged upwardly either by its monolithic attachment with the flange or brackets or by one or more springs at the hinge connection between the cover and flange.

All embodiments include at least one catch engagement passage formed through the sheet or panel, which automatically engages a corresponding number of pins secured to the underside of the upper portion of the drawer opening. As the drawer is opened, the panel is urged against the upper portion of the drawer opening and the engagement passage(s) catch(es) on the pin(s) to stop further opening of the drawer. The engagement passages(s) may be configured with a narrower slot extending therefrom, and the pin(s) may be configured with a narrower portion between the head and the base. This arrangement captures the engagement slot positively upon the pin as the narrower slot is pulled about the narrower portion of the pin, thereby preventing a person from pushing the protective panel downwardly into the drawer. The engagement passage(s) may be symmetrical, with a narrower slot extending to each side or end of the centrally disposed larger diameter opening. The drawer is closed, or opened, slightly to align the larger diameter portion of the engagement passage with the head of the pin before the panel may be lowered to disengage it from the pin and allow the drawer to be either opened fully or closed.

According to one embodiment, the cover is comprised of three portions, a central portion and opposite end portions that are adjustably extendable laterally in order to match the overall width of the cover to an inside width of the drawer to ensure substantially complete coverage of the drawer opening.

Numerous other advantages and features of the present invention will be become readily apparent from the following detailed description of the invention and the embodiments thereof, from the claims and from the accompanying drawings.

BRIEF DESCRIPTION OF THE DRAWINGS

FIG. 5 is a top perspective view of an alternate embodiment of the invention.

FIG. 6 is an exploded top perspective view of the embodiment of FIG. 5.

FIG. 7 is a rear perspective view of a portion of the embodiment shown in FIG. 6.

FIG. 8 is a bottom view of the embodiment of FIG. 5.

FIG. 9 is a sectional view taken generally along line 9-9 of FIG. 5.

Similar reference characters denote corresponding features consistently throughout the attached drawings.

DETAILED DESCRIPTION OF THE PREFERRED EMBODIMENTS

Figure 1:
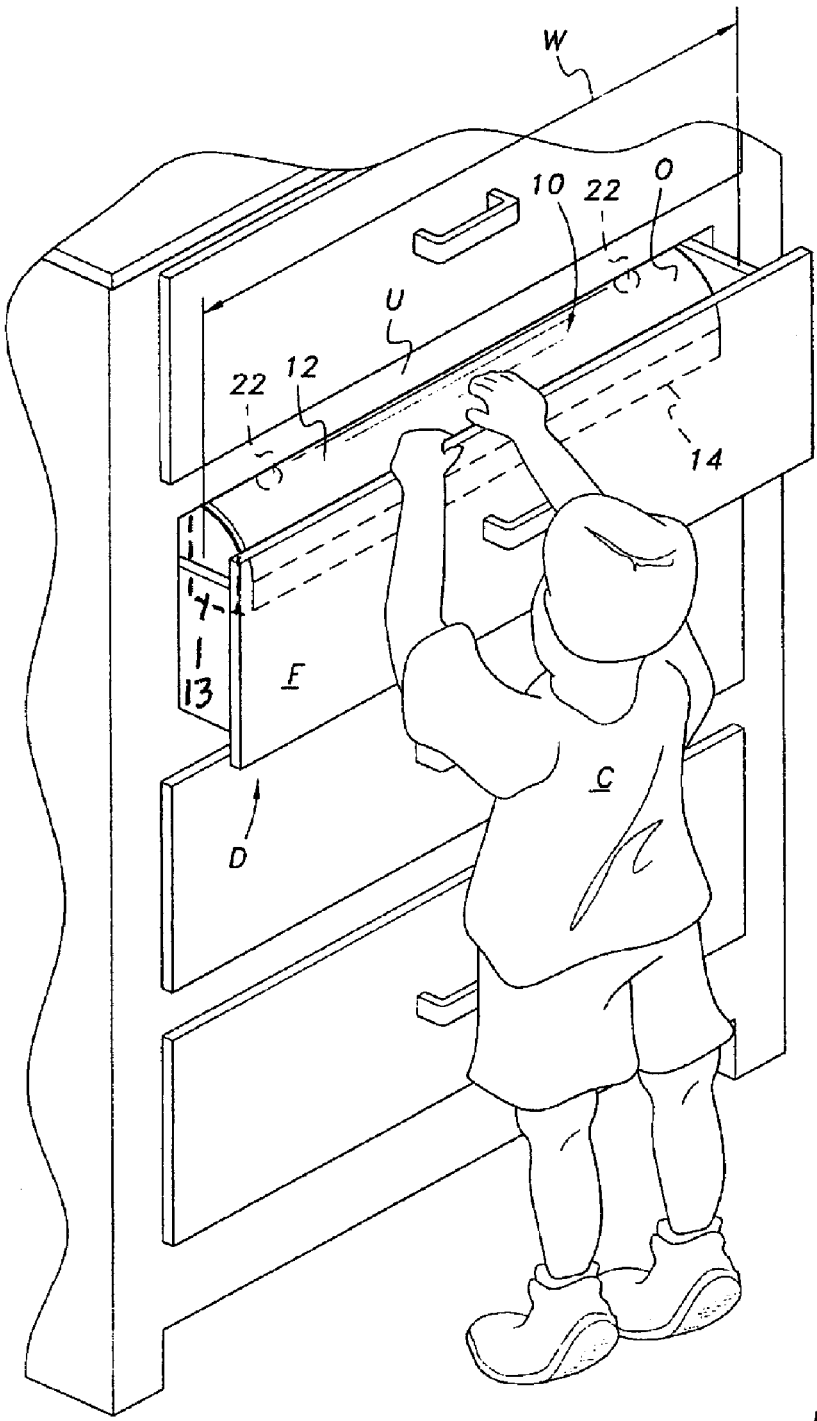
FIG. 1 is an environmental, perspective view of the drawer security attachment according to the present invention, showing its general configuration and operation.

While this invention is susceptible of embodiment in many different forms, there is shown in the drawings and will herein be described in detail preferred features of the invention. It will be understood, however, that the present disclosure is to be considered as an exemplification of the principles of the invention and is not intended to limit the invention to the specific form of the combination of features that are illustrated and described.

The present invention comprises various embodiments of a drawer security attachment having a flexible or hinged panel that spans substantially the entire interior volume of the drawer and extends over at least a portion of the interior volume of the drawer and its contents to block casual access to the contents of the drawer. FIG. 1 provides an environmental perspective view showing the operation of the drawer security attachment 10 installed within a drawer D that has been pulled open by a small child C. The security attachment 10 includes a panel or drawer content cover 12 which spans essentially the entire width W of the drawer D, as is clearly shown in FIG. 1, to preclude casual access to the contents of the drawer D.

In the case of drawers D having relatively low sides, the cover 12 may optionally include lateral extensions 13, as shown in broken lines to the left side of the drawer cover 12 in FIG. 1. Such extensions 13 overlap the upper edge of the side panels of the drawer, thereby making it more difficult for a person to insert his or her hand between the cover 12 and the upper edge of a relatively low drawer side panel.

The cover 12 automatically locks into place against the overlying upper frame member U of the drawer opening O to keep the drawer D from being opened further without proper manipulation of the drawer D and cover 12, as explained further below.

Figure 2:
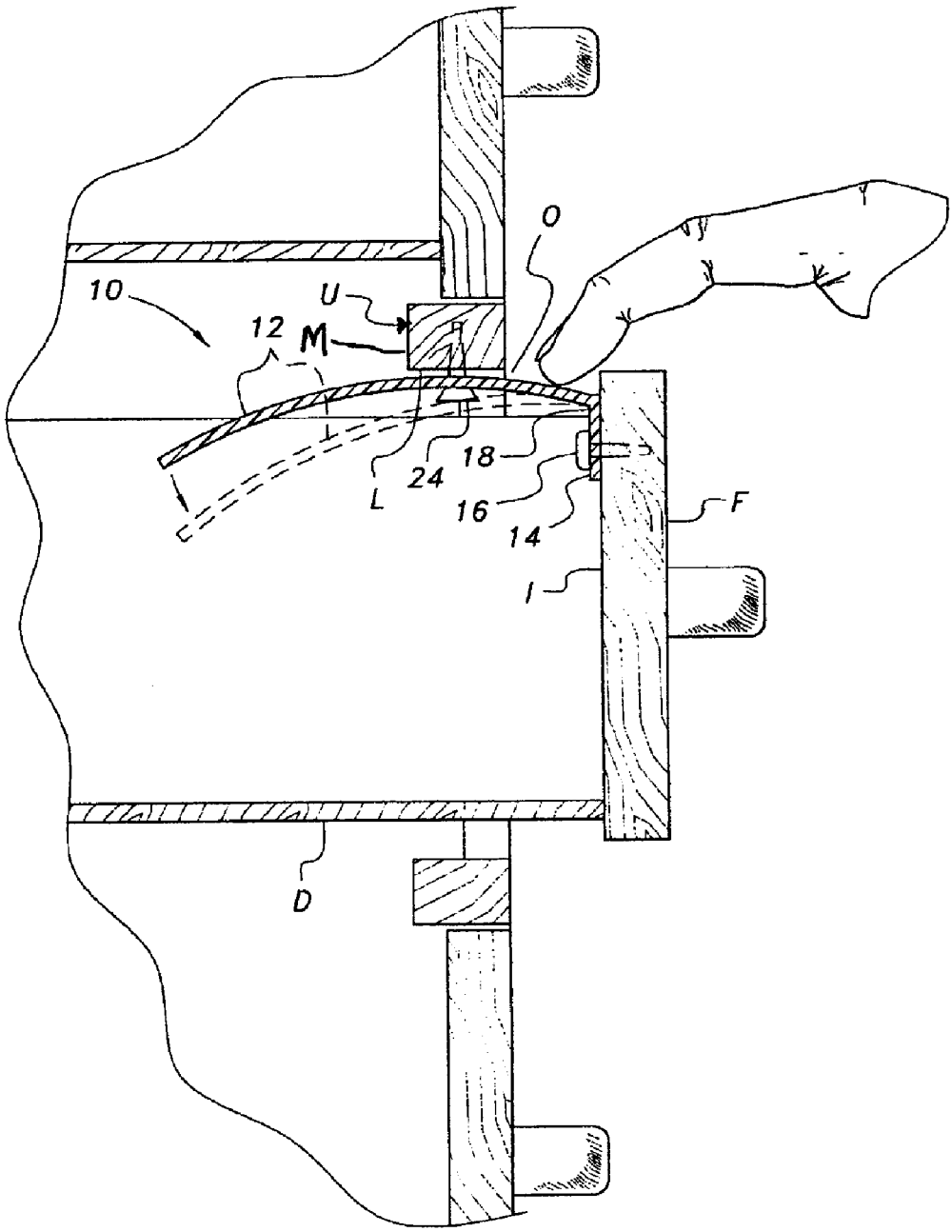
FIG. 2 is a side elevation view in section through a chest of drawers, showing further details of the drawer security attachment of the present invention.

FIG. 2 provides a more detailed side elevation view in section of the present drawer security attachment 10, showing further details thereof. The content cover 12 comprises a flexible panel of plastic or other suitable material, which is formed integrally with a drawer front attachment flange 14. The attachment flange 14 may comprise a single, elongate flange having essentially the same width as the drawer content cover 12 and spanning essentially the entire interior width W of the drawer D, or may alternatively comprise a series of tabs extending from the attachment edge of the cover 12. The attachment flange 14 secures to the inner surface I of the drawer front face F, e.g., by screws 16 or other suitable attachment means.

The drawer content cover 12 flexes resiliently along its integral attachment edge 18 with the drawer front attachment flange 14. The attachment edge 18 may be thinned or narrowed, as shown in FIG. 2, to facilitate flexibility along that line. The cover 12 need not be particularly deep, i.e., need not extend deeply into the drawer D from the front face F of the drawer toward the back of the drawer. The depth need only be sufficient to provide essentially complete coverage of the drawer contents when the drawer D is opened a few inches or so, generally as shown in FIG. 2.

The drawer content cover 12 has an upwardly convex arch toward the upper frame member U of the drawer opening O when the drawer D is opened, as is shown clearly in the side elevation view in section in FIG. 2. The hinge line 18 joining the content cover 12 to the flange 14 is formed to urge or flex the content cover 12 upwardly, to be biased against the overlying upper frame member U of the drawer opening O when the drawer D is opened. The resilient, flexible nature of the cover 12 and its hinge line 18 with its attachment flange 14 results in the upper surface of the cover 12 bearing against the lower surface L of the upper frame member U of the drawer opening O, or against any protrusions depending from the lower surface L of the upper member U.

Figure 3:
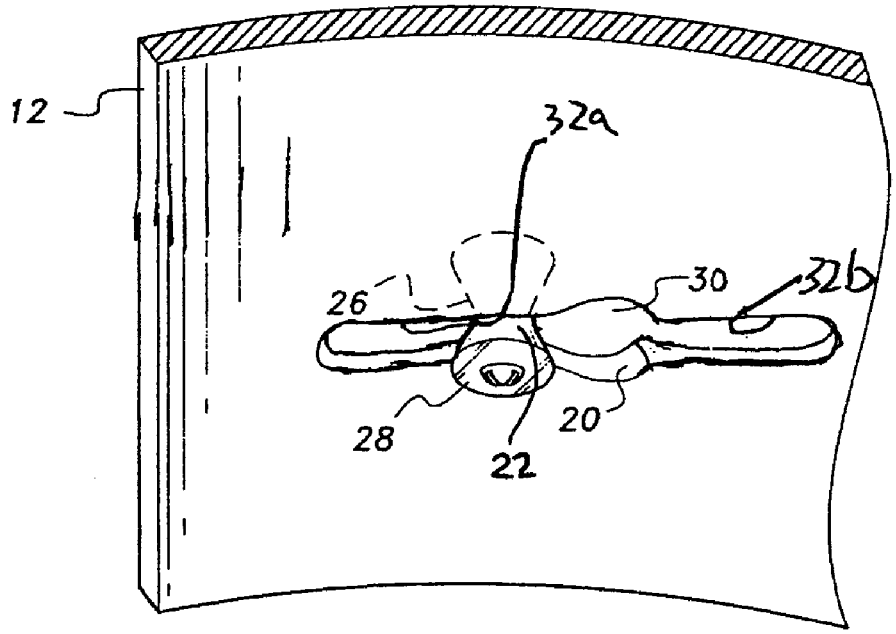
FIG. 3 is a partial bottom perspective view of the drawer security attachment of the present invention, showing the security catch mechanism.

The drawer content cover 12 is formed with at least one, pin engagement passage(s) 20 therethrough, an example of which is shown in the detailed perspective view of FIG. 3. These passages 20 automatically engage corresponding cover catch pins 22, which are secured to the lower surface L of the upper frame member U of the drawer opening. The pins 22 may alternatively comprise conventional screws 24, as shown in the side elevation view in section of FIG. 2. Preferably the pins 22 or screws 24 are provided with a relatively narrow shank or neck portion 26 and a relatively larger diameter distal head portion 28, as shown clearly in FIG. 3. The pin engagement passages 20 are preferably formed to have a relatively wider or larger diameter catch pin clearance portion 30, which is at least slightly larger in diameter than the head 28 of the catch pin 22 or screw 24. A narrower slot extends from the wider diameter portion 30, which the slot being narrower than the diameter of the catch pinhead 28, but at least slightly wider than the diameter of the narrower neck portion 26. At least one such slot is provided, but preferably two slots 32*a* and 32*b* are provided on diametrically opposite sides of the central larger diameter catch pin clearance portion 30 of the passage 20.

When the drawer D is pulled open, the inherent upward bias of the drawer content cover 12 causes the catch pin clearance portion 30 of the pin engagement passage 20 to pass upwardly around the head 28 of the catch pin 22 (or screw 24, as in FIG. 2), toward the narrower neck portion 26 of the pin. Further opening of the drawer D results in the narrower slotted portion 32*a* of the catch pin engagement passage 20 sliding about the narrower necked portion 26 of the pin. This simultaneously prevents the drawer D from being opened further, and also prevents the cover 12 from being pushed downwardly to disengage from the pin 22 (or 24) due to the slotted portion 32 of the passage 20 being too narrow to pass over the larger diameter head 28 of the catch pin 22 or screw 24. The only way the drawer D may be opened further is to first push it slightly closed to align the larger diameter portion 30 of the catch pin engagement passage 20 with the head 28 of the pin or screw, and then to push the cover 12 slightly downwardly (as shown in broken lines in FIGS. 2 and 4) to cause the larger diameter portion 30 of the passage 20 to pass over the head 28 of the pin or screw, while simultaneously pulling the drawer D open. The relatively shallow depth of the cover 12 allows the cover to flex upwardly to a vertical position, or for the user to flex the cover upwardly, without having the cover block a substantial vertical span or area above the drawer front F.

A person who does not have a thorough understanding of the above described latch or catch assembly, may attempt to disengage the cover 12 from the pin(s) 22 by pushing the drawer closed again, essentially attempting to reverse the action which cased the cover 12 to catch on the pin(s) 22. However, with the two diametrically opposed slots 32*a* and 32*b*, the cover 12 will remain engaged upon the pin(s) 22 as the drawer is pushed closed and the second slot 32*b* engages the narrower shank portion 26 of the pin(s). It will thus be seen that the drawer D must be precisely positioned to align the wider central catch pin clearance portions(s) 30 of the passage(s) 20 with the corresponding head(s) 28 of the pin(s) 22, in order to disengage the cover 12 from the pin(s). A person who understands the above described catch pin and engagement passage configuration need only apply slight downward pressure to the drawer content cover 12 while sliding the drawer D slightly inwardly or outwardly until the wider central portion 30 of the engagement passage(s) 20 align with the head(s) 28 of the pin(s) 22. When this occurs, the cover 12 will flex downwardly to disengage from the pin(s) 22, whereupon the drawer D may be opened further as desired. Once the drawer D is opened sufficiently for the distal edge of the cover 12 to clear the drawer opening, the inherent spring tension provided by the material along the hinge line 18 causes the cover 12 to fold upwardly, thereby exposing the contents of the drawer for access.

Figure 4:
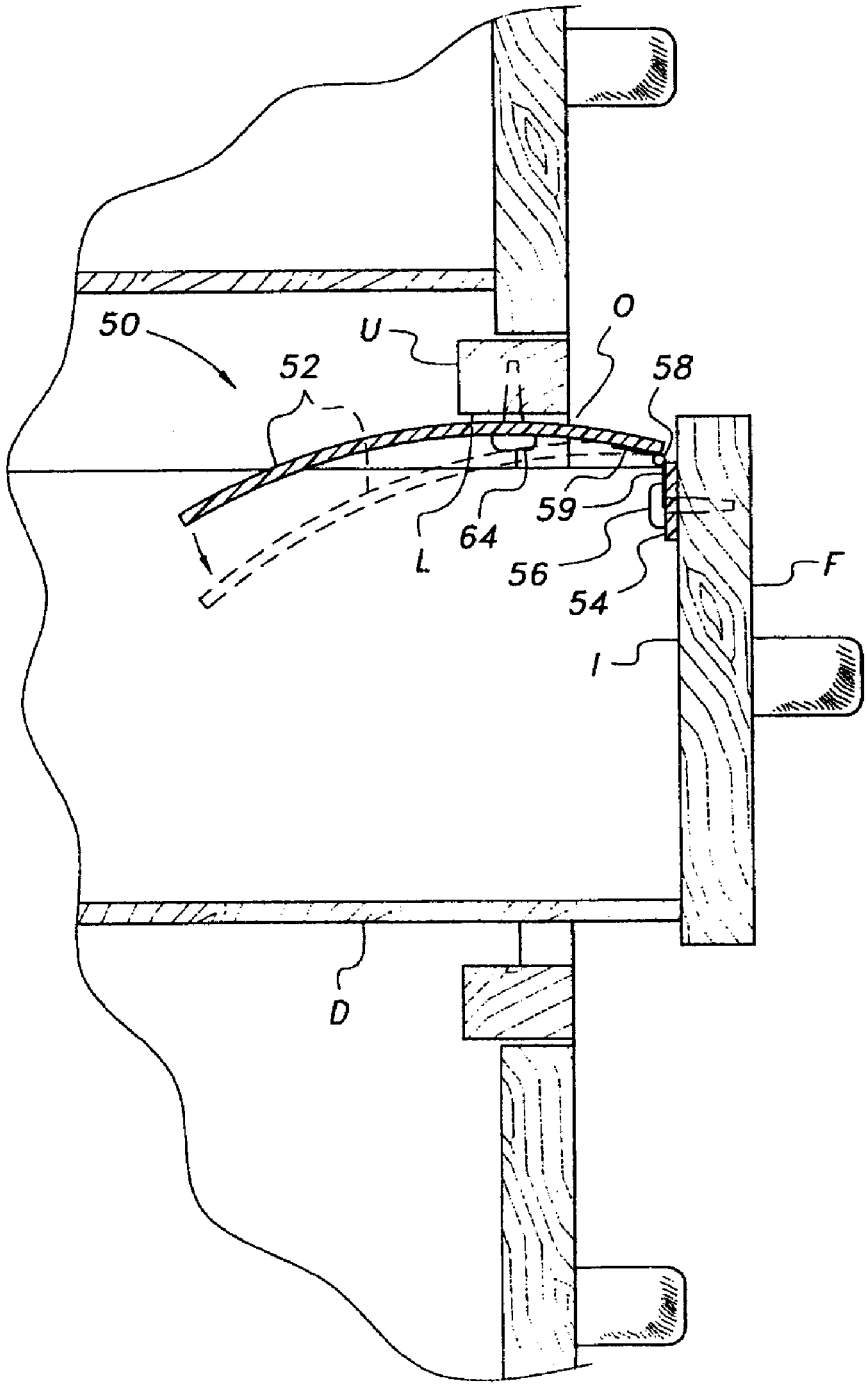
FIG. 4 is a side elevation view in section through a chest of drawers, showing details of an alternative embodiment of a drawer security attachment according to the present invention.
Figure 10:
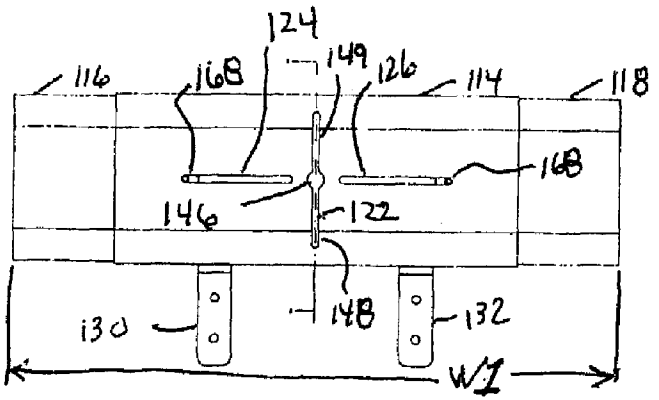
FIG. 10 is a plan view of the embodiment of FIG. 5.

FIG. 4 of the drawings provides a side elevation view in section of an alternative embodiment of a drawer security attachment, designated as attachment 50. The embodiment illustrated in FIG. 4 is quite similar to the embodiment 10 of FIGS. 1 through 3, excepting the connection between the drawer content cover panel and its drawer front attachment flange. In the embodiment 50 of FIG. 4, the drawer content cover 52 is connected to the attachment flange 54 by a mechanical cover attachment hinge 58, rather than the cover and flange being formed as a unitary flexible sheet, as in FIGS. 1 and 2. The attachment flange 54 is secured to the inner surface I of the front face F of the drawer D by a series of screws 56, corresponding to the attachment screws 16 of the embodiment 10 of FIGS. 1 and 2, or other suitable attachment means. In the embodiment 50 of FIG. 4, the cover 52 (and flange 54) may be formed of more rigid materials, e.g., sheet metal, etc., if so desired. One or more springs 59 (e.g., coiled about the hinge 58, or leaf or other spring type) are biased against the face of the drawer front attachment flange 54 and attachment edge portion of the cover 52, urging the cover 52 upwardly against the lower surface L of the upper frame member U of the drawer opening O to engage the catch pin, e.g., screw 64 in FIG. 4, just as in the case of the embodiment 10 shown in FIGS. 1 and 2. The springs 59 provide sufficient force to cause the cover 52 to pivot upwardly about its hinge 58 to allow complete access to the interior of the drawer when the distal edge clears the drawer opening as the drawer is more fully opened.

FIG. 5 provides a perspective view of an alternate embodiment drawer security attachment assembly 100 to be installed within a drawer D such as shown in FIG. 1 in a similar fashion to the previously described embodiments. The security attachment assembly 100 includes a panel or drawer content cover 112 which spans essentially the entire width W of the drawer D, to preclude casual access to the contents of the drawer D.

The cover 112 automatically locks into place against the overlying upper frame member U of the drawer opening O to keep the drawer D from being opened farther without proper manipulation of the drawer D and cover 112, as explained further below.

The cover 112 includes a central portion 114 and two adjustably extendable end portions 116, 118 that are identical in configuration. The center portion 114 includes a longitudinal slot 122, and two collinear lateral slots 124, 126. The center portion 114 is connected via plastic living hinges 130*a*, 132*a* to two attachment brackets 130, 132 that secure to the inner surface I of the drawer front face F. e.g., by screws 16 or other suitable attachment means such as shown in FIG. 2.

The central portion 114 and end portions 116, 118 each comprise a flexible panel of plastic or other suitable material. The central portion 114 flexes resiliently along the living hinges 130*a*, 132*a* of the brackets 130, 132. The brackets 130, 132 are formed integrally with the central portion 114 and the living hinges 130*a*, 132*a* are formed by the material between the central portion 114 and the brackets 130, 132 being thinned or narrowed to facilitate flexibility along that hinges.

The cover 112 need not be particularly deep, i.e., it need not extend deeply into the drawer D from the front face F of the drawer toward the back of the drawer. The depth need only be sufficient to provide essentially complete coverage of the drawer contents when the drawer D is opened a few inches or so, generally as shown in FIG. 2.

The drawer content cover 112, including the portions 114, 116, 118, has an upwardly convex arch toward the upper frame member U of the drawer opening O when the drawer D is opened as shown in FIG. 9. The hinges 130*a*, 132*a* joining the content cover 112 to the brackets 130, 132 is formed to urge or flex the content cover 112 upwardly, to be biased against the overlying upper frame member U of the drawer opening O when the drawer D is opened. The resilient, flexible nature of the cover 112 and its hinges 130*a*, 132*a* with its attachment brackets 130, 132 results in the upper surface of the cover 112 bearing against the lower surface L of the upper frame member U of the drawer opening O, or against any protrusions depending from the lower surface L of the upper member U.

The slot 122 automatically engages a corresponding cover catch pin 138 formed on an L-shaped bracket 140, which is secured to the lower surface L of the upper frame member U of the drawer opening. The inside surfaces 140*a*, 140*b* (FIG. 9) of the L-shaped bracket can be provided with an adhesive covered by a release sheet that can be removed during installation of the apparatus to a drawer and the bracket 140 pressed against the surfaces L and/or M respectively (FIG. 2) to install the bracket 140 and thus the pin 138 to the frame member U instead of by fastening the pin by screwing as shown in FIG. 2.

The pin 138 is provided with a relatively narrow shank or neck portion 141 and a relatively larger diameter distal head portion 142, as shown clearly in FIG. 7. The slot 122 is preferably formed to have a relatively wider or larger diameter catch pin clearance portion 146, which is at least slightly larger in diameter than the head 142 of the catch pin 138. Narrower slot portions 148, 149 extends in opposite longitudinal directions from the wider diameter portion 146, which the slot being narrower than the diameter of the catch pin head 142, but at least slightly wider than the diameter of the narrower neck portion 141.

When the drawer D is pulled open, the inherent upward bias of the drawer content cover 112 causes the catch pin clearance portion 146 of the pin engagement slot 122 to pass upwardly around the head 142 of the catch pin 138, toward the narrower neck portion 141 of the pin. Further opening of the drawer D results in the narrower slotted portion 149 of the catch pin engagement slot 122 sliding along the narrower necked portion 141 of the pin until the pin reaches a terminal point 149*a* of the slotted portion 149. This simultaneously prevents the drawer D from being opened further, and also prevents the cover 112 from being pushed downwardly to disengage from the pin 138 due to the slotted portion 149 of the slot 122 being too narrow to pass over the larger diameter head 142 of the catch pin 138. The only way the drawer D may be opened further is to first push it slightly closed to align the larger diameter portion 146 of the catch pin engagement slot 122 with the head 142 of the pin 138, and then to push the cover 112 slightly downwardly to cause the larger diameter portion 146 of the slot 122 to pass over the head 142 of the pin, while simultaneously pulling the drawer D open. The relatively shallow depth of the cover 112 allows the cover to flex upwardly to a vertical position, or for the user to flex the cover upwardly, without having the cover block a substantial vertical span or area above the drawer front F.

A person who does not have a thorough understanding of the above described latch or catch assembly, may attempt to disengage the cover 112 from the pin 138 by pushing the drawer closed again, essentially attempting to reverse the action which caused the cover 112 to catch on the pin 138. However, with the two diametrically opposed slots 148, 149, the cover 112 will remain engaged upon the pin 138 as the drawer is pushed closed and the second slot 148 engages the narrower shank 141 of the pin. It will thus be seen that the drawer D must be precisely positioned to align the wider central catch pin clearance portion 146 of the slot 122 with the corresponding head 142 of the pin 138, in order to disengage the cover 112 from the pin. When the head 142 registers with the wider clearance portion 146 a slight click may be felt. A small formation such as a small molded bump or button (not shown) can be molded onto an underside of the central portion 114 adjacent the clearance portion 146 to amplify or enhance this click.

A person who understands the above described catch pin and engagement passage configuration need only apply slight downward pressure to the drawer content cover 112 while sliding the drawer D slightly inwardly or outwardly until the wider clearance portion 146 of the engagement slot 122 aligns with the head 142 of the pin 138. When this occurs, the cover 112 will flex downwardly to disengage from the pin 138, whereupon the drawer D may be opened further as desired. Once the drawer D is opened sufficiently for the distal edge of the cover 112 to clear the drawer opening, the inherent spring tension provided by the material along the hinges 130*a*, 132*a* causes the cover 112 to fold upwardly, thereby exposing the contents of the drawer for access.

The embodiment of FIGS. 5-16 provides enhanced coverage of the top open space of an opened drawer in that the end portions 116, 118 are adjustable outwardly from the central portion 114 to create an overall lateral dimension W1 (FIG. 10) that substantially matches the width W of the drawer.

Figure 13:
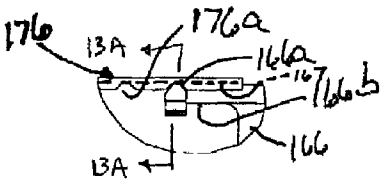
FIG. 13 is a fragmentary, enlarged view of a portion of FIG. 12.
Figure 11:
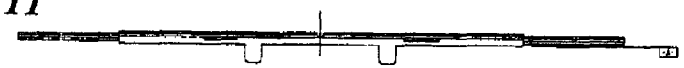
FIG. 11 is a front view of the embodiment of FIG. 5.
Figure 13A:
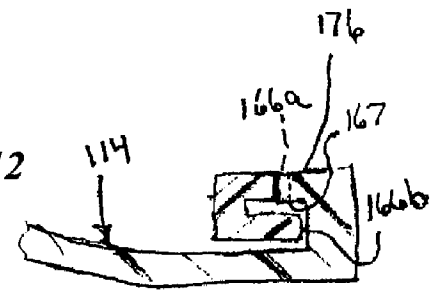
FIG. 13A is a fragmentary sectional view taken along line 13A-13A of FIG. 13.
Figure 14:
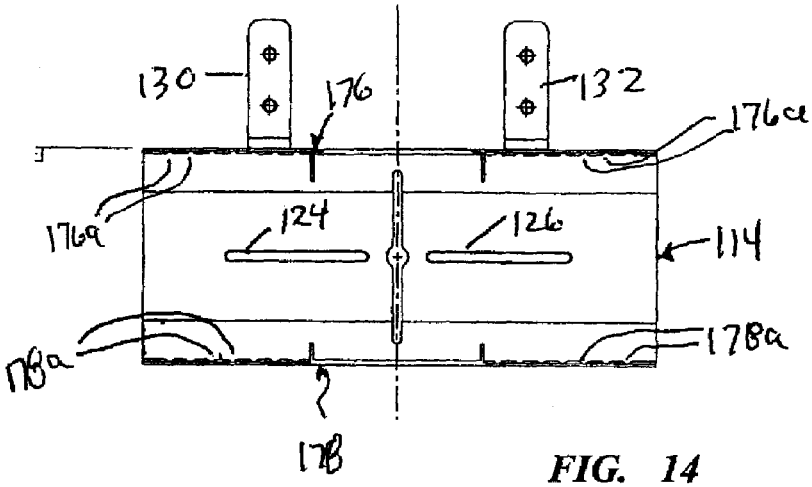
FIG. 14 is a bottom view of a center portion of the embodiment of FIG. 5.
Figure 15:
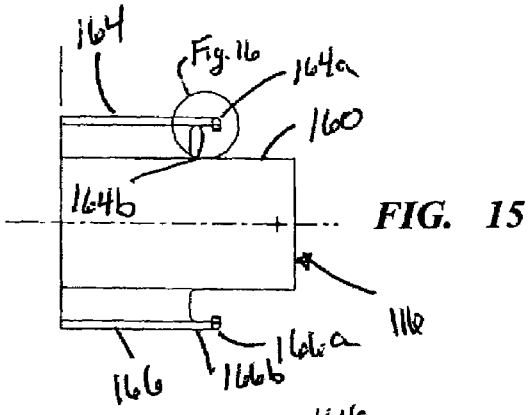
FIG. 15 is a bottom view of an end portion of the embodiment of FIG. 5.
Figure 16:
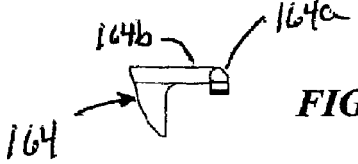
FIG. 16 is a fragmentary, enlarged view of a portion of FIG. 15.

To accomplish this lateral adjustability, the end portions 130, 132 each include a body portion 160 formed with opposing guide portions 164, 166. The guide portions 164, 166 include detents 164*a*, 166*a* that have tapered ends that extend longitudinally in opposite directions. The detents 164*a*, 164*b* are formed on cantilever portions 164*b*, 166*b* (see FIGS. 15 and 16) and are offset in elevation from the cantilever portions, as shown in FIG. 13A.

During assembly of the end portions 116, 118 with the central portion 114, outer edge regions of the guide portions 164, 166 of each end portion 116, 118 are slidably or telescopically fit into respective laterally extending C-shaped channels 167, 169 that are arranged on opposite longitudinal ends of the central portion 114. The channels 167, 169 are formed by L-shaped walls 176, 178 extending down from of the central portion. FIGS. 13 and 13A illustrate a guide 166 slid into the channel 167 formed by the wall 176. The simultaneous fitment of the opposite guide 164 into the channel 169 is identical.

One of two pins 168 or other suitable element slides through the respective collinear lateral slot 124, 126 during lateral dimension adjustment of the cover 112. The pins serve as limit stops for the inward and outward movement of the end portions 116, 118 with respect to the central portion 114, and help to guide the lateral adjustment along with the channels 167, 169.

Figure 12:
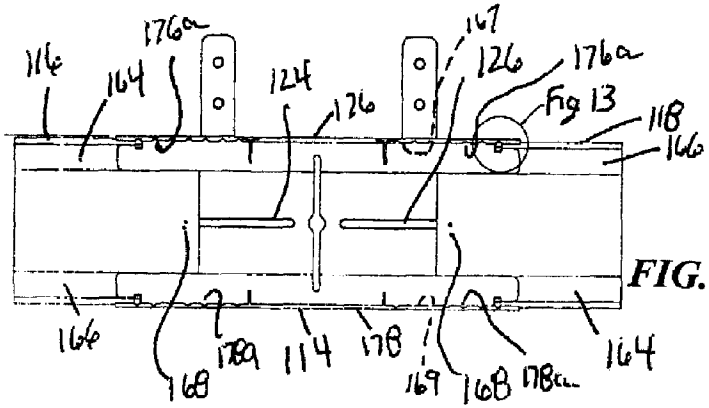
FIG. 12 is a bottom view of the embodiment of FIG. 5.

The opposite detents 164*a*, 166*a* engage selected oppositely disposed notches 176*a*, 178*a* formed along the facing surfaces of the laterally extending walls 176, 178 of the central portion 114, as shown in FIG. 12. The detents 164*a*, 166*a* are offset in elevation on the cantilever portions 164*b*, 166*b* of the guides 164, 166 respectively so that the detents 164*a*, 166*a* can engage the notches 176*a*, 178*a* while the outside edges of the guides 164, 166 can slide through the channels 167, 169. The detents 164*a*, 166*a* are formed on the cantilever portions 164*b*, 166*b* of the guides 164, 166 respectively such that the detents have sufficient resiliency to be flexibly released from the notches 176*a*, 178*a* by bending of the cantilever portions 164*b*, 166*b* toward each other.

In conclusion, the drawer security attachment in its various embodiments provides excellent protection against casual entry into a kitchen drawer, a drawer in a chest of drawers, when installed therein. The upward biasing of the cover panel assures that it will automatically engage the cooperating catch pin to stop the opening of the drawer after only a few inches or so. Moreover, the configuration of the catch pin(s) and corresponding passage(s) in the cover require specific manipulation of the drawer in order to disengage the cover from the pin(s), which will likely be beyond the knowledge or abilities of a small child who is unaware of the operation of the drawer security attachment.

However, when a knowledgeable adult desires access to the contents of the drawer, he or she need only pull the drawer open, then push the drawer slightly closed while pushing downwardly on the cover to disengage the cover from the pin(s). The drawer may then be opened normally, with the biasing of the cover urging it to a fully opened position to provide complete access to the contents of the drawer. Closure of the drawer is accomplished by reversing the above procedure, i.e., tucking the cover back into the drawer opening and pushing the drawer closed. Accordingly, the drawer security attachment will prove to be a most valuable and desirable household accessory for parents and guardians of small children and others who have need to protect drawers and the like from casual entry.

It is to be understood that the present invention is not limited to the embodiments described above, but encompasses any and all embodiments within the scope of the following claims.

The invention claimed is:

1. A drawer security attachment, comprises:

an elongated drawer front attachment body adapted for attachment to a surface of a drawer face; and an elongated drawer content cover flexibly attached to the attachment body and extending rearward therefrom, the cover having a width adapted for substantially spanning a lateral width defined by opposing sidewalls of the drawer so that the cover extends across the width of the drawer and substantially covers a drawer opening to inhibit access to the drawer, the drawer opening defined, in part, by the drawer face and opposing sidewalls for at least part of the front-to-rear depth of the drawer opening;

wherein said cover comprises at least two cover portions that are coupled together and are laterally, adjustably extendable from each other to adjust an overall lateral dimension of said cover with respect to the lateral width defined by the opposing sidewalls of the drawer.

2. The drawer security attachment according to claim 1, wherein one of said two cover portions comprises a detent and the respective other of said two cover portions comprises a series of notches for receiving said detent, a relative lateral extension between said two cover portions is set by putting said detent into a selected one of said notches.

3. The drawer security attachment according to claim 2, wherein one of said two cover portions comprises a slot elongated in a longitudinal direction of sliding open and closed of said drawer, said slot having a narrow region and a wider region, said wider region being sized to receive an enlarged head of a retaining pin, said narrow region sized to not pass the enlarged head of said pin but to pass a narrow shank of said pin that is adjacent to said enlarged head for attaching the cover to a frame member of the drawer opening to inhibit access to the drawer.

4. The drawer security attachment according to claim 3, wherein one of said two cover portions comprises a channel, wherein the respective other of said two cover portions comprises an edge region that is slidable in said channel to adjust an overall lateral dimension of said cover.

5. The drawer security attachment according to claim 3, wherein said narrow region of said slot extends in said longitudinal direction on both ends of said wider region.

6. The drawer security attachment according to claim 1, wherein said attachment body comprises two spaced apart brackets.

7. A drawer security attachment, comprising:

an elongated drawer front attachment body adapted for attachment to a surface of a drawer face; and an elongated drawer content cover flexibly attached to the attachment body and extending rearward therefrom, the cover having a width adapted for substantially spanning a lateral width defined by opposing sidewalls of the drawer so that the cover extends across the width of the drawer and substantially covers a drawer opening to inhibit access to the drawer, the drawer opening defined, in part, by the drawer face and opposing sidewalls for at least part of the front-to-rear depth of the drawer opening;

wherein said cover comprises a slot elongated in a longitudinal direction of sliding open and closed of said drawer, said slot having a narrow region and a wider region, said wider region being sized to receive an enlarged head of a retaining pin, said narrow region sized to not pass the enlarged head of said pin but to pass a narrow shank of said pin that is adjacent to said enlarged head for attaching the cover to a frame member of the drawer opening to inhibit access to the drawer.

8. A drawer security attachment, comprising a one-piece sheet of flexible material having:

a drawer front attachment body adapted for attachment to a surface of a drawer face;

a drawer content cover extending rearward from the drawer attachment body, the cover having a width adapted for substantially spanning a lateral width defined by opposing sidewalls of the drawer so that the cover extends substantially across the width of the drawer to inhibit access to the drawer; and a resilient joint joining the cover substantially normal to the body;

wherein said cover comprises a slot elongated in a longitudinal direction of sliding open and closed of said drawer, said slot having a narrow region and a wider region, said wider region being sized to receive an enlarged head of a retaining pin, said narrow region sized to not pass the enlarged head of said pin but to pass a narrow shank of said pin that is adjacent to said enlarged head for attaching the cover to a frame member of the drawer opening to inhibit access to the drawer.

9. The drawer security attachment according to claim 8, wherein said narrow region of said slot extends in said longitudinal direction on both ends of said wider region.

10. A drawer security arrangement for securing the contents of a drawer that is slidably carried by a drawer frame, comprising:

a retaining device having an anchor portion for attachment to a portion of the drawer frame that is adjacent to a drawer face, a shank extending from said anchor portion toward the drawer, and an enlarged head extending from said shank;

a drawer front attachment body adapted for attachment to a surface of the drawer face;

at least one cover attachment hinge extending from the attachment body; and a drawer content cover attached to the hinge and extending therefrom, the cover having a width adapted for substantially spanning a lateral width defined by opposing sidewalls of the drawer so that the cover extends substantially across the width of the drawer and substantially covers a drawer opening defined by the drawer face and opposing sidewalls for at least part of the front-to-rear depth of the drawer opening for inhibiting access to the drawer, wherein said cover comprises a slot elongated in a longitudinal direction of sliding open and closed of said drawer, said slot having a narrow region and a wider region, said wider region being sized to pass said enlarged head of said retaining device, said narrow region sized to not pass said enlarged head of said retaining device but to pass said shank of said retaining device, said enlarged head securing said cover to said frame while sliding of said drawer relatively moves said shank through said narrow region.

11. The drawer security arrangement according to claim 10, wherein said narrow region of said slot extends in said longitudinal direction on both ends of said wider region.

12. The drawer security arrangement according to claim 10, wherein said attachment body comprises two spaced apart brackets.

13. The drawer security arrangement according to claim 10, wherein said hinge comprises a living hinge.

14. The drawer security arrangement according to claim 10, wherein said cover comprises two portions that are laterally, adjustably extendable from each other to adjust an overall transverse dimension of said cover.

15. The drawer security arrangement according to claim 14, wherein one of said two portions comprises a detent and the respective other of said portions comprises a series of notches for receiving said detent, a relative lateral extension of said one portion with respect to said other portion set by putting said detent into a selected one of said notches.

16. The drawer security arrangement according to claim 14, wherein said two portions of said cover are engageable telescopically and selectively extendable to adjust the overall lateral dimension of said cover.

* * * * *